US006609704B2

(12) United States Patent
Satterfield

(10) Patent No.: US 6,609,704 B2
(45) Date of Patent: Aug. 26, 2003

(54) FLUID EMULSIFICATION SYSTEMS AND METHODS

(76) Inventor: John R. Satterfield, 248 South Ave., Poughkeepsie, NY (US) 12601

( * ) Notice: Subject to any disclaimer, the term of this patent is extended or adjusted under 35 U.S.C. 154(b) by 0 days.

(21) Appl. No.: 09/776,122

(22) Filed: Feb. 2, 2001

(65) Prior Publication Data

US 2001/0016607 A1 Aug. 23, 2001

Related U.S. Application Data

(63) Continuation of application No. 09/131,185, filed on Aug. 7, 1998, now Pat. No. 6,211,251.

(51) Int. Cl.[7] ..... B01F 3/04
(52) U.S. Cl. ..... 261/123; 261/124
(58) Field of Search ..... 261/123, 77, 124, 261/79.1, 79.2

(56) References Cited

U.S. PATENT DOCUMENTS

| | | | | | |
|---|---|---|---|---|---|
| 484,721 | A | * | 10/1892 | Parris | 261/123 X |
| 656,409 | A | * | 8/1900 | Laraway et al. | 261/123 X |
| 797,615 | A | * | 8/1905 | Schmitt | 261/124 X |
| 1,041,480 | A | | 10/1912 | Kaley | |
| 1,144,342 | A | * | 6/1915 | Andrews | 261/123 X |
| 1,822,888 | A | | 9/1931 | Haysel | |
| 1,969,960 | A | | 8/1934 | Blum | 225/21 |
| 1,985,165 | A | * | 12/1934 | Hapgood | 261/123 |
| 1,994,766 | A | * | 3/1935 | Heglar | 261/123 X |
| 2,029,556 | A | * | 2/1936 | Brown | 261/124 X |
| 2,034,430 | A | | 3/1936 | Farrow | 61/50 |
| 2,985,524 | A | | 5/1961 | Jacobus | 48/180 |
| 3,245,666 | A | * | 4/1966 | Marsee | 261/65 |
| 3,330,773 | A | | 7/1967 | De Hart | 516/10 |
| 3,429,676 | A | * | 2/1969 | Gatza | 261/123 X |
| 3,685,808 | A | | 8/1972 | Bodai | 261/1 |
| 3,756,580 | A | * | 9/1973 | Dunn | 261/123 |
| 3,962,381 | A | * | 6/1976 | Farrish et al. | 261/123 X |
| 4,217,313 | A | | 8/1980 | Dmitrievsky et al. | 261/41 |
| 5,472,645 | A | * | 12/1995 | Rock et al. | 261/79.1 |
| 6,211,251 | B1 | * | 4/2001 | Satterfield | 516/10 |

FOREIGN PATENT DOCUMENTS

| | | | | |
|---|---|---|---|---|
| IT | 436484 | | 3/1949 | 261/79.1 |
| JP | 55-75558 | * | 6/1980 | 261/123 |

OTHER PUBLICATIONS

"*Automotive Mechanics*" (10th Ed.), by William H. Crouse and Donald L. Anglin, McGraw–Hill (1993), Chapter 21, pp. 261–277.

"*Holley Carburetors and Manifolds*" by Mike Urich and Bill Fisher, HP Books (1976), pp. 16–54.

"*How Jet Engines Are Made*" by Julian Moxon, Threshold Books Limited (1985), pp. 1–32.

* cited by examiner

*Primary Examiner*—Richard L. Chiesa
(74) *Attorney, Agent, or Firm*—Steven G. Lisa; Douglas W. Rudy

(57) ABSTRACT

This invention describes systems and methods for mixing two fluids. A first fluid, usually fuel, is passed through a primary passage that typically leads to a carburetor or other inlet to a combustion engine. A second fluid, usually air, is mixed with the first by introducing it to the primary passage through an inlet located upstream in the primary passage. The mixture of fluids is then further emulsified by passing it over a plurality of obstructions, such as a threaded interior surface of the primary passage, located within the primary passage downstream of the inlet.

5 Claims, 9 Drawing Sheets

FLUID EMULSIFICATION SYSTEMS AND METHODS

This application is a continuation of Ser. No. 09/131,185 filed Aug. 7, 1998,now U.S. Pat. No. 6,211,251.

FIELD OF INVENTION

This invention relates generally to a fluid emulsification system. More specifically, this invention relates to systems and methods that promote uniform and homogeneous emulsification of a liquid (such as fuel) by blending a gas (such as air) with the liquid. One application of the invention is in fuel delivery systems, such as used for internal combustion engines, where thorough and homogeneous emulsification of the fuel and air results in greatly increased engine efficiency.

BACKGROUND OF INVENTION

Emulsification of a fluid stream occurs by introducing air or gas into the fluid stream, and is beneficial in many applications. For example, it is known to form an emulsion of air with fuel flowing to the carburetor to an internal combustion engine, with the benefit of increasing the efficiency of combustion. The more homogeneous and complete the air is emulsified with the fuel, the more efficient the combustion process will be. Combustion that is more efficient results in better performance with reduced pollution and emissions. Emulsification of a fuel charge with air is beneficial not only in standard combustion engines, but also in other applications such as jet engines, turbines, home heating systems, paint spraying, perfume dispensing, and the like.

Many prior art systems have attempted, without success, to achieve complete fuel/air emulsification. Most of those systems relate to emulsification of fuel with air for an internal combustion engine. Some such systems attempt to emulsify the fuel downstream of the venturi region of a carburetor, while other such systems attempt emulsification within the venturi region. Still other systems attempt emulsification at the point of fuel delivery. Those prior art systems fail to completely, or homogeneously, emulsify the air and fuel mixture.

FIGS. 1 and 1A are simplified diagrams depicting a standard carburetor having a known emulsification system as used in commercially available Holly® carburetors. Several references discuss the general subject of carburetor operation. See, for example, *Super Tuning and Modifying Holley Carburetors,* by Dave Emanuel (S-A Design Books, E. Brea, Calif., 1988), and *Holley Carburetors,* by Mike Urich and Bill Fisher (H P Books, Los Angeles, Calif., 1987). Both of those books are incorporated herein by reference. Their descriptions of carburetor operation include short discussions on the importance and operation of an emulsion tube in a carburetor.

In the normal operation of a carburetor, the fuel 8 is delivered from a source 10 to a float bowl 12. A float 14 meters the amount of fuel retained in the bowl through a valve system such as a needle and seat assembly 15. The fuel enters a main well 18 through a power valve circuit 16 and/or a main jet 17. The downward stroke of a piston in the engine creates a differential between atmospheric pressure and the pressure in the engine cylinder. The pressure differential creates a partial vacuum in the venturi region 22 of the carburetor and draws the intake air 23 through the venturi. The venturi effect causes the fuel to discharge through nozzle 20 forming a mixture 24 of ambient air and fuel. This air-fuel mixture passes through throttle valve 25 and the intake manifold system to the cylinders, where it is combusted by engine 26.

The prior art carburetor of FIGS. 1 and 1A include an emulsion tube 28 shown in communication with the main well 18 through one or more air channels or ports 30. The emulsion tube 28 obtains air from an air intake orifice 32, which is typically located upstream of the venturi portion of the carburetor. The mixing force of the air attempts to break down the fuel into an air/fuel mixture before it enters the venturi region of the carburetor. However, the mixing is not homogeneous or complete, and is only partially effective.

More specifically, the deficiency in the design of FIGS. 1 and 1A results primarily because the walls of the main well 18 and emulsion tube 28 are simple smooth walled cylinders. Therefore, the air introduced into the fuel stream follows a path of least resistance, which in the smooth bore well design, is an uninterrupted path close to the surface of the wall. In FIGS. 1 and 1A small circles ("o") represent the air and dashes ("-") represent the fuel. An emulsification is represented by a homogeneous distribution of air and fuel. As shown most clearly in FIG. 1A, the air drawn through the emulsion tube 28 mixes with the fuel only in a local or limited area close to the smooth walls of the main well 18. There are no provisions in the main well 18 to keep the air and fuel in a frothy emulsified state or to continuously direct, redirect or tumble the air back into the flowing fuel 8. Therefore, the air-fuel mixture remains primarily in a stratified form with only incomplete or partial emulsification of the fuel occurring at the areas where air enters air inlets or bleed holes 30 of the main well 18.

Other prior art is likewise not successful at fully emulsifying the air-fuel mixture. For example, U.S. Pat. No. 3,685,808 to Bodai describes a fuel delivery system that attempts to emulsify the fuel by introducing supersonic swirled air through a single air inlet positioned tangent to the end of the fuel nozzle. However, in actuality, the air does not swirl at all, but takes the shortest route by primarily flowing straight through and following the smooth contour of the fuel delivery tube. The air and fuel thus remain in a relatively stratified form. There will be some fuel aeration at the point where the non-swirling air enters the fuel delivery tube through the single air inlet. However, the complete air-fuel mixture is at best only partially aerated.

U.S. Pat. No. 1,041,480 to Kaley purports to disclose a system that aggravates the intake air in the air channel down stream from the fuel nozzle. The wall of the intake air channel of the Kaley patent is threaded or knurled in an attempt to aggravate the intake air prior to mixing with the fuel. In reality the knurled or threaded surface of the intake air channel causes an unwanted "throttling" effect thus restricting the flow or volume of air and fuel delivered to the combustion area.

U.S. Pat. No. 4,217,313 to Dmitrievsky et al. attempts to accomplish the creation of an air-fuel emulsion by trying to swirl air down-stream from a venturi. Air above the throttle valve, and at the same pressure as the upstream throttle chamber, passes around the throttle in a separate air passage to a circular air chamber below the venturi. Dmitrievsky teaches that the air pressures both above the throttle valve and in separate air chamber below the venturi are higher than that of the down-stream throttle chamber. Therefore, the intake air above the throttle valve is supposedly forced into the air passage leading to the circular air chamber. Dmitrievsky presumes that the circular shape of the air chamber will cause the air to swirl vigorously and exit an annular passageway. A depression in the annular passage (venturi effect) then causes the air to move at sonic velocity. Dmitrievsky teaches that because the air is at sonic velocity and swirling, the invention achieves fine atomization and uniform mixing of the air and fuel. However, conventional testing has established that the swirling of air in such a configuration is almost non-existent. As a result, the air-fuel mixture will in all likelihood remain in the same stratified state as the mixture immediately down-stream of the venturi, and thus, is of very little benefit to fuel emulsification.

Italian Patent 434,484 to Bertolotti teaches a fuel/air mixing system that purportedly swirls the air within the main throttle area of the venturi. However, this system does little to promote fuel emulsion. Conventional flow bench testing has determined that any type of rough or threaded surface in the venturi region will only restrict the air flow through the venturi, thus slowing down the throttle response and reducing engine horsepower capabilities.

U.S. Pat. No. 1,969,960 to Blum relates to a drink dispenser used to aerate and mix a liquid drink. The Blum device attempts to mix and aerate the liquid by introducing two fluids (air and a drinking fluid) of equal pressures but different viscosity into a common chamber located above a dispenser nozzle containing a spiral band. However, because the liquids are of different viscosity, the volume of each liquid passing through the dispenser nozzle will be different. In practice, this causes the heavier liquid to separate unevenly from the thinner liquid, and little aeration of the drinking liquid occurs within the nozzle chamber. Most, if not all, of the aeration occurs at the sharp beveled end of the nozzle dispenser that forces the liquid from one side of the dispenser nozzle to the other side of the dispenser nozzle.

U.S. Pat. No. 2,034,430 to Farrow describes a carburetor system in which air enters a mixing chamber through a throttle valve. Within the mixing chamber is a cone having an apex faced in the direction of the main intake air. The surface of the cone is comprised of a grid of longitudinal ribs and a series of circular steps. Fuel enters the mixing chamber through a helix shaped passageway and distributes onto the surface of the cone's ribs and steps. This is supposed to uniformly cover the cone with a thin liquid film of fuel separated into finely divided particles. When main air from the intake enters the mixing chamber, the fuel vaporizes, resulting in a homogeneous air-fuel mixture. This process, known as air stream atomization, does not use a secondary inlet air for fuel emulsification. However, the device does use a secondary idle air intake but that has nothing to do with fuel emulsification.

U.S. Pat. No. 2,985,524 to Jacobus describes a device that attaches to the delivery side or lower end of the carburetor barrel. The device primarily consists of a nozzle body on the delivery side of the carburetor. The nozzle body that is comprised of a plurality of helical channels that purportedly cause the fuel to spiral or swirl before entering the venturi chamber. However, at no point is air introduced into this delivery system. Therefore, there is no possibility for increased air-fuel emulsification.

In view of the above prior art, the need exists to improve fuel atomization by more effective emulsification of an air-fuel mixture. The emulsification improvement system should have the ability to be easily and readily adapted into most existing fluid delivery systems. Although the specification is largely directed to improved emulsification systems and methods used in carburetors for internal combustion engines, the invention is also applicable other systems where it is desirable to have enhanced emulsification.

SUMMARY OF THE INVENTION

It is an object of this invention to provide an improved fuel emulsion device that is easily incorporated into existing carburetor systems.

It is an object of this invention to improve fuel emulsion and negate fuel stratification by introducing air into the fuel delivery portion of the carburetor through an elongated and threaded fuel channel.

It is a further object of this invention to improve fuel emulsion and negate fuel stratification by causing the air-fuel mixture to roil and tumble to form a frothy emulsion.

It is another object of this invention to improve fuel emulsion by passing the air-fuel mixture over threaded or knurled surfaces before introducing the mixture into the venturi portion of the carburetor.

It is another object this invention to improve fuel emulsion by confining the air/fuel mixture within the main fuel well by using a straight helix or spiral shaped insertion rod that enhances the tumbling of the air/fuel mixture.

It is an object of this invention to improve engine performance and fuel economy by providing better and faster combustion of the fuel.

It is a further object of this invention to provide faster and more efficient combustion, thus allowing for a reduction of heat on component contact surfaces and reduction of engine cooling requirements.

It is an object of this invention to provide combustion that is more efficient and diminish exhaust volume.

It is an object of this invention to reduce the emissions from engines by more thorough and efficient combustion of fuel.

It is an object of this invention to promote air-fuel emulsion for internal combustion engines that use fuel injection systems to supply fuel to the combustion chamber.

It is an object of this invention to promote air-fuel emulsion for jet or turbine engines.

It is an object of this invention to promote air-fuel emulsion for propane engines or natural gas heaters.

It is an object of this invention to promote emulsion formation for paint sprayers.

It is an object of this invention to promote emulsion formation for perfume dispensers.

The above and other objects are achieved by a method for mixing two fluids. The method comprises the acts of passing a first fluid through a primary passage and mixing a second fluid with the first fluid. The second fluid is mixed with the first by introducing it to the primary passage through an inlet located upstream in the primary passage. The mixture of fluids is then further emulsified by passing it over an obstruction located within the primary passage down stream of the inlet. In the preferred embodiment of the method, first fluid is combustible fuel and the second fluid is air. To increase the mixing effect, the second fluid may be introduced to the first fluid through a plurality of inlets to the primary passage, and the mixture is passed over a threaded interior surface within the primary passage. Ideally, the threaded interior surface is formed on a portion of the wall of the passage extending downstream between and after each inlet. The emulsifying effect of the present invention is enhanced by restricting the volume of the primary passage so as to maintain the mixture within a reduced are a as it passes over the obstruction(s).

The above and other objects are also achieved by a system for emulsifying a primary and secondary fluids. The system includes a passage for the primary fluid and an inlet for the secondary fluid. The inlet is located upstream in the passage. An obstruction within the passage is located downstream of the inlet for the secondary fluid. In its preferred form, the passage comprises a fuel well leading to a venturi, the inlet for the secondary fluid comprises an air inlet and the obstruction comprises a plurality of raised protrusions extending from an inside surface of the fuel well into the path of the fuel. For example, the plurality of raised protrusions may comprise threads formed on the inside surface of the fuel well. In a modification of the system, a restrictor is placed within the volume of the fuel well. The restrictor may comprise a length of threaded rod placed parallel to the fuel well.

The above-described methods and systems have application not only for internal combustion engines, but also furnaces, jet engines and other areas where complete emulsification of the two mixtures is desired.

The preferred embodiments of the inventions are described in the following Detailed Description. Unless specifically noted, the words and phrases in the specification and claims are intended to have their ordinary and accustomed meaning to those of ordinary skill in the applicable arts. If any other meaning is intended, the specification will specifically state that a special meaning is being applied to a word or phrase. Likewise, the use of the words "function" or "means" in the Detailed Description is not intended to indicate a desire to invoke the special provisions of 35 U.S.C. Section 112, paragraph 6 to define the invention. To the contrary, if the provisions of 35 U.S.C. Section 112, paragraph 6, are sought to be invoked to define the inventions, the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. Section 112, paragraph 6. Moreover, even if the provisions of 35 U.S.C. Section 112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

BRIEF DESCRIPTION OF THE DRAWINGS

The preferred embodiment and characteristics and benefits of the present invention can be more easily understood from the following description of the preferred and alternative embodiments in combination with the accompanying drawings, in which.

DETAILED DESCRIPTION OF THE INVENTION

In describing a preferred embodiment of the present invention, references are made to FIGS. 1–7 of the drawings in which like numbers refer to like features of the invention. None of these figures present the invention and the environment in true scale. That is, the relationship and sizes of various illustrated components are presented to convey the essence of the invention and provide a teaching of the invention. In an actual embodiment the emulsion tube when used in a conventional carburetor for instance would have a diameter more on the order of 0.25 inches. Moreover, in alternative embodiments (e.g., jet engines) the scale would be much larger. Once the invention is understood in its preferred form, one of ordinary skill in the art can easily apply it to applications other than a conventional carburetor.

Figure 1:
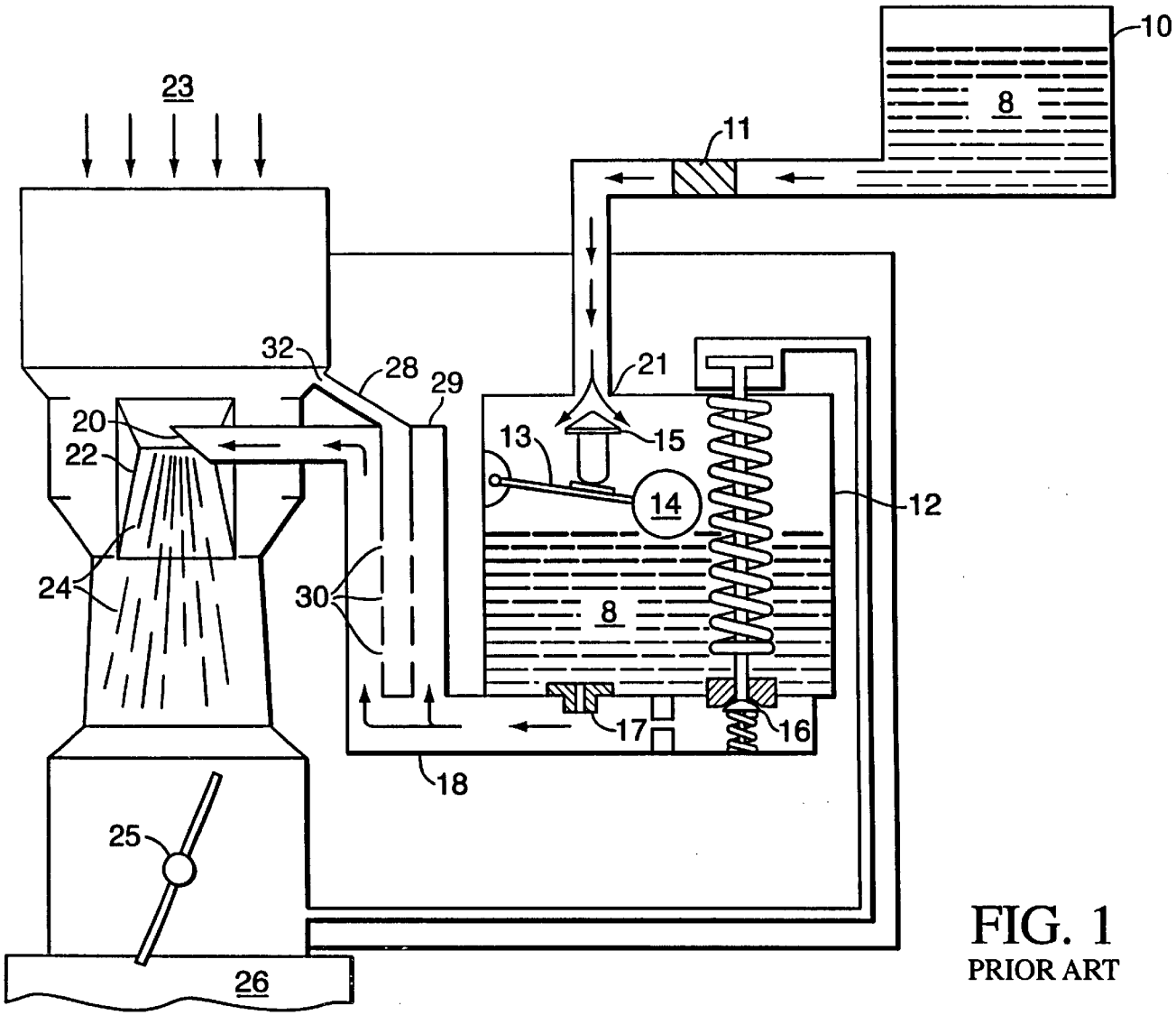
FIG. 1 PRIOR ART
FIG. 1 is a cross sectional functional view of a simplified pictorial representation of a Holley® carburetor and fuel supply system.
Figure 1A:
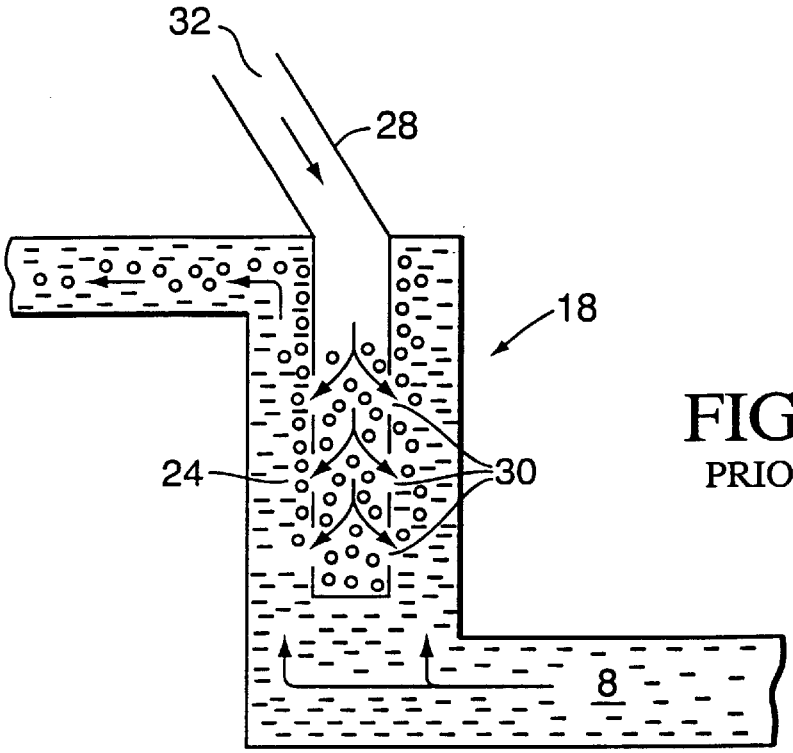
FIG. 1A PRIOR ART
FIG. 1A is a pictorial representation of a main well of as could be found in the Holley® carburetor of FIG. 1.

FIGS. 1 and 1A depict a prior art form of carburetor. Fuel 8 flows from a source 10 in the direction of the arrows and passes through a screen or filter 11, a needle and seat valve assembly 15, and into fuel bowl 12. As fuel fills the fuel bowl 12, it lifts a float 14. Coupled to float 14 is a hinged lever arm 13 that pushes on the needle of the valve assembly 15 when the float 14 rises. When the fuel 8 in the fuel bowl 12 reaches a preset level, the needle 15 seals against a seat 21, thus allowing no more fuel 8 to enter the fuel bowl 12 and main well 18. This process continuously repeats itself as the operation of the engine 26 drains the fuel bowl 12. The standard forms of emulsion tubes attempted in such prior art devices were discussed above in the Background of the Invention.

FIGS. 2A through 2E depict an improved emulsion system that promotes the maintenance of a homogeneously emulsified air-fuel mixture in the main well of the carburetor.

Figure 2A:
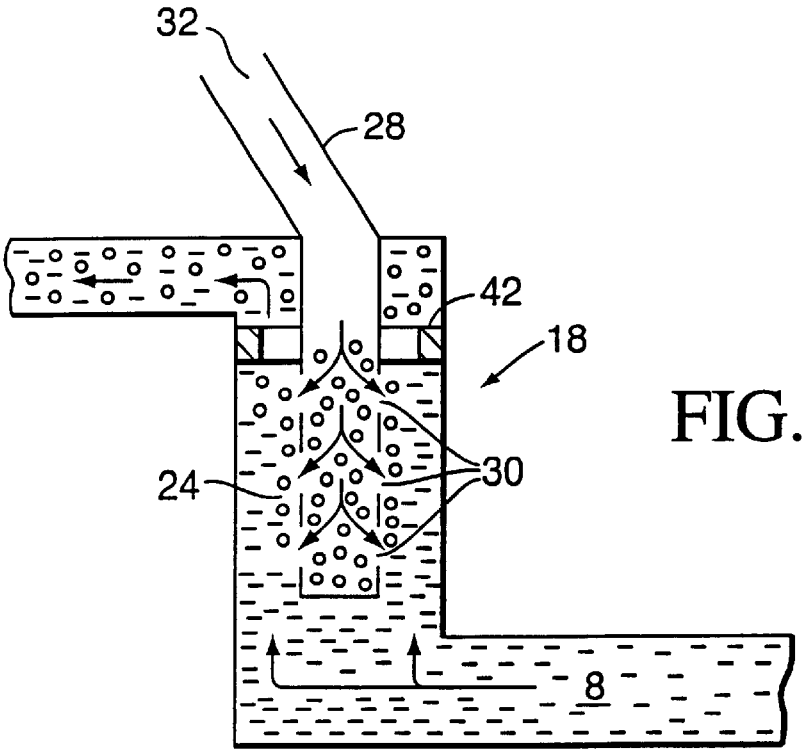
FIG. 2A is a schematic representation of one embodiment of the invention that improves the operation of the carburetor of FIGS. 1 and 1A.
Figure 2B:
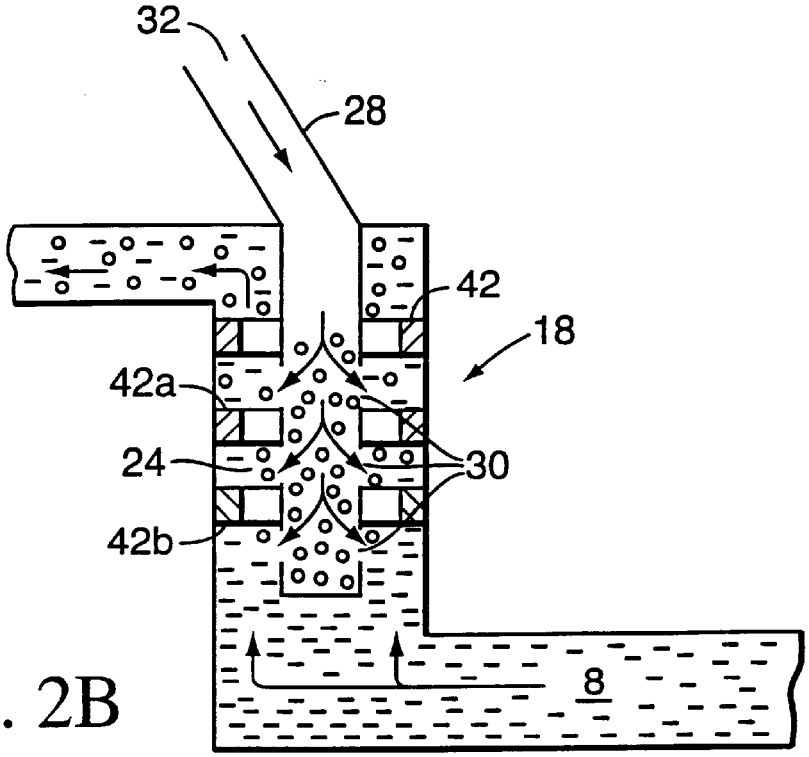
FIG. 2B is an alternative embodiment to the invention shown in FIG. 2A.
Figure 2C:
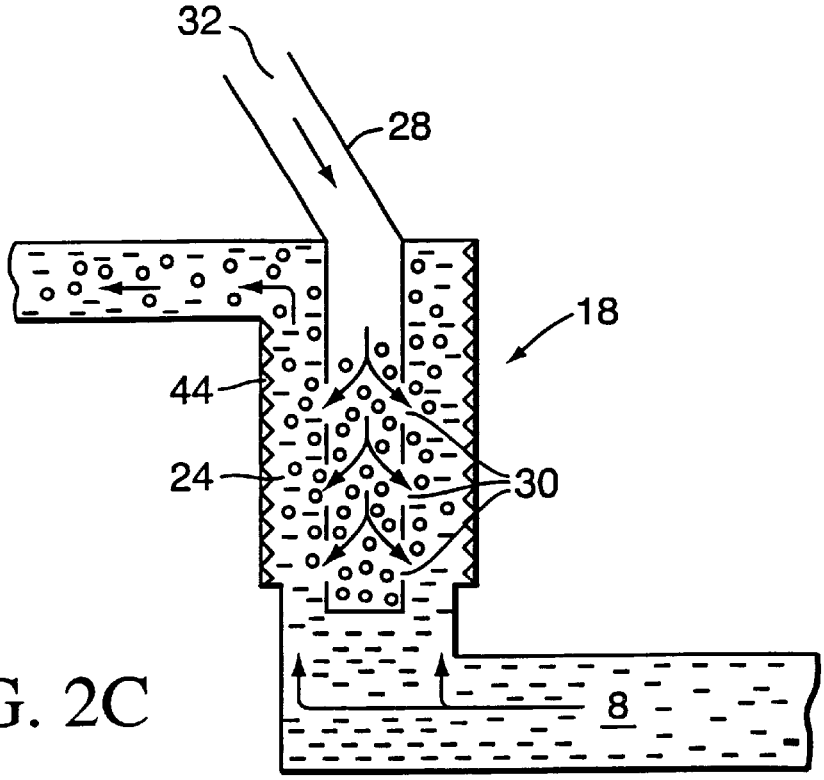
FIG. 2C is yet another alternative to the invention shown in FIG. 2A.

In FIG. 2A, air passes through an intake orifice 32 into an emulsion tube 28. The air well or emulsion tube 28 includes at least one, and preferably several, ports or air bleed holes 30. Fuel 8 flows to the main well from the fuel bowl as described above. The illustration in FIG. 2A shows in cross-section a ring, thread or other obstruction 42. The ring or thread 42 is located on the inside wall of the main well relatively downstream of the bleed holes 30 in the air well 28. The ring 42 presents a surface in the path of the air-fuel mixture that causes the mixture to roil, turbulate, tumble and disassociate from the walls of the main well. Thus, the ring 42 acts to improve the amount of emulsification of the air-fuel mixture as compared to smooth-walled surfaces in the prior art device of FIGS. 1 and 1A. FIG. 2B shows an alternative embodiment having a plurality of rings, threads or obstructions 42, 42*a* and 42*b,* in the interior of the main well. The multiple rings more thoroughly emulsify the air-fuel mixture. FIG. 2E discloses another alternative embodiment in which the rings, threads or obstructions 50 formed on the emulsion tube 28.

In the embodiments shown in FIGS. 2A and 2B and 2E the rings 42 (or 50) are formed as continuous rings on the inner surface of the main well. Of course, one could use partial rings and still obtain increased emulsification relative to the smooth-walled prior art. Likewise, if the main well 18 is not tubular, the rings 42 would conform to the interior shape of the main well. Similarly, in the embodiment of FIG. 2E, different shapes and configurations of the emulsion tube 28 would require that the shape and configuration of the rings 50 also conform thereto. The grooves 42 or 50 preferably have well-defined edges to further enhance emulsion.

In still another alternative, the rings 42 or 50 that extend into the interior of the main well 18 can take the form of grooves or threads. Specifically, FIG. 2C shows an alternative embodiment of the invention in which the interior surface of the main well is threaded with a continuous thread 44. The size and spacing of the thread can vary depending on the application. However, even small threads that are widely spaced will improve the degree of emulsification compared to the prior art emulsion systems shown in FIGS. 1 and 1A. By using a thread 44, a plurality of relatively sharp projections can be formed in the interior of the main well relatively easily.

The thread 44 defines a nominal major surface as defined by a line drawn from the tips of adjacent projections. The machined wall surface of the main well 18 defines a nominal minor diameter at the root or base of adjacent threads 44 between the thread projections. Thus, in FIGS. 2A and 2B the nominal major surface would be the diameter across the well 18 defined at the tips of the thread projections. The nominal minor surface will be the larger diameter of the main well passage root or base of adjacent thread projections. This nomenclature also applies to the structures set forth in the remaining Figures. The thread 44 presents numerous projections over which the mixture of air and fuel must flow, and therefore acts to maximize the mixture of air and fuel being delivered to the carburetor venturi.

Figure 2D:
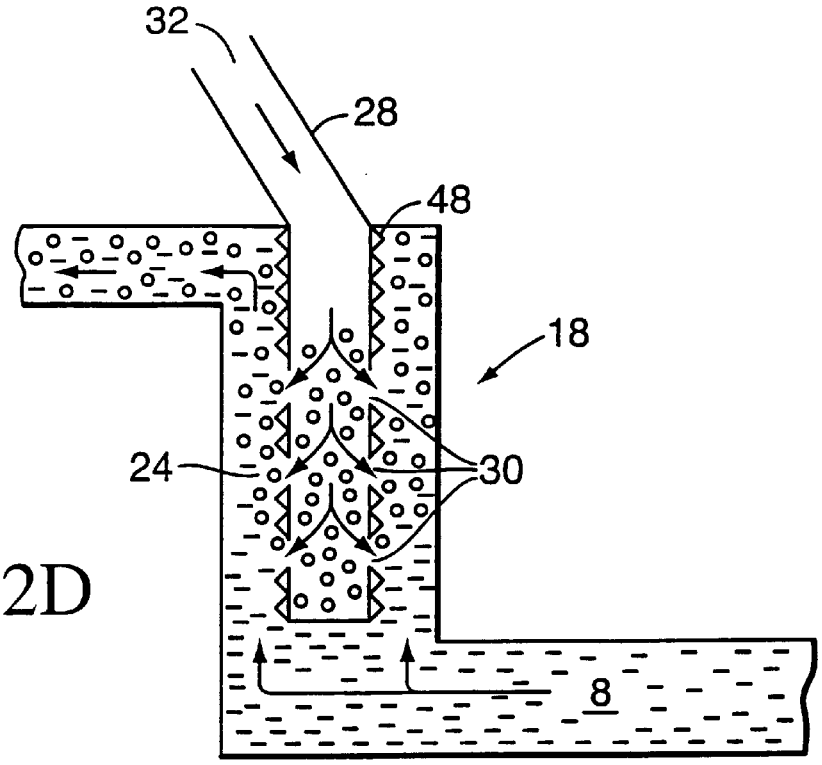
FIG. 2D is another alternative embodiment to the invention shown in FIG. 2A.
Figure 2E:
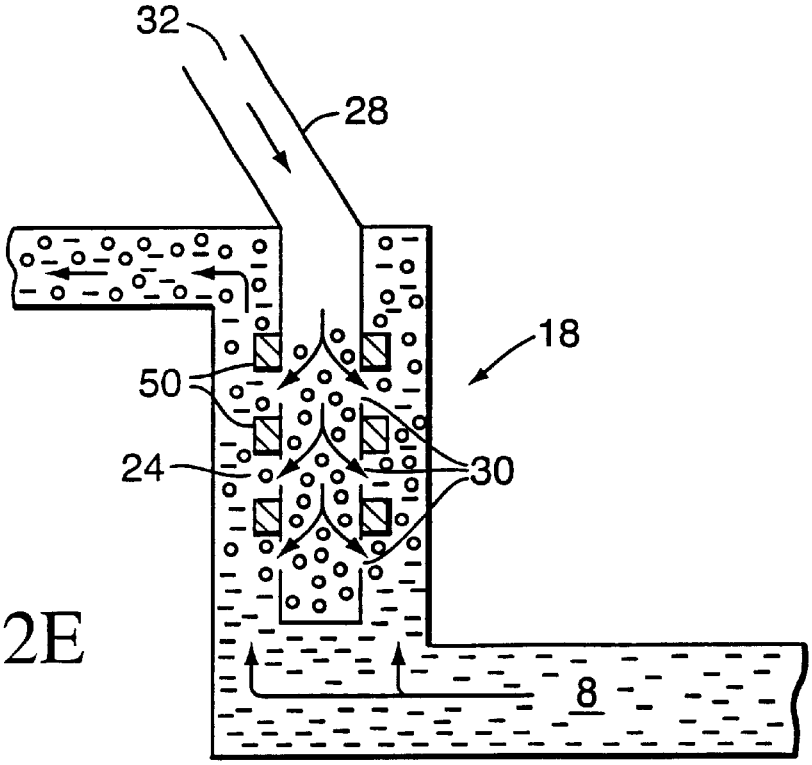
FIG. 2E is an alternative embodiment to the invention shown in FIG. 2D.

FIGS. 2D and 2E show an embodiment of the invention with the threads 48 and rings 50 placed on the exterior surface of the emulsion tube 28 within the well 18. In both of these embodiments the projections 48 and 50 extend outwardly from the wall of the emulsion tube 28 into the path of the air-fuel mixture. By extending into the path of the air-fuel mixture, the air exiting the ports 30 is forced to more thoroughly emulsify the fuel when compared to the smooth-walled emulsion tube shown in FIGS. 1 and 1A.

Though not shown, the embodiments of FIGS. 2A, 2B and 2C can be combined with the embodiments of FIGS. 2D and 2E, incorporating both an emulsion tube 28 with threads, rings or obstructions and a main well 18 with threads, rings or obstructions. In addition, FIGS. 4 and 5 below show another embodiment in which a threaded restrictor 36 is employed to further enhance emulsification. It is contemplated that such a restrictor rod could also be used in the FIG. 2 embodiments, for example, by inserted the rod in a spiral fashion between the emulsion tube 28 and the nominal major surface of the main well 18.

Figure 3:
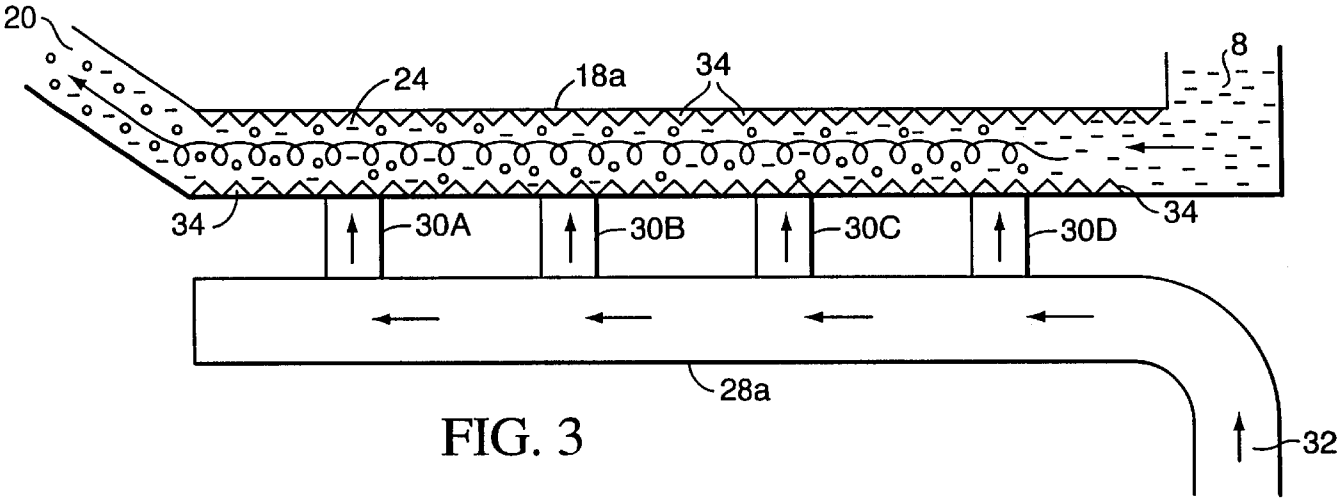
FIG. 3 is a side schematic view of a preferred embodiment of the invention.

FIG. 3 shows a preferred embodiment of the invention having more universal application in other fuel systems. The discussion that follows addresses the preferred embodiment of emulsifying air and fuel. However, as discussed above, it is to be understood that other applications also exist. As in the embodiments above, the fuel 8 flows through a fuel well, line or passage 18*a.* Again, the use of the word "well", "line", or "passage", are to be given the broadest possible interpretation, as the specific structure of the well, line or passage is not relevant to the scope of the invention.

The fuel well, line or passage 18*a* includes at least one, and preferably a plurality, of obstructions, rings or threads 34. Air is supplied to the well 18*a* from an emulsion tube 28*a* through at least one, and preferably a plurality, of channels or passages 30A–30D. As the fuel flows through the passage 18*a,* air likewise flows through air channels 30A–30D. The air and fuel are thoroughly and homogeneously mixed to together due to the turbulence and spiraling action of the mixture induced by the obstructions, rings or threads 34. Indeed, if the threads 34 are placed along a substantial portion of the length of the passage 18*a*, emulsification continues and is enhanced as the air-fuel mixture travels through the passage. The emulsification is still further enhanced by the introduction of air through additional passages 30A, 30B and 30C located downstream of passage 30D. The embodiment of FIG. 3 allows the air and fuel to achieve an increased percentage of air/fuel emulsification prior to exiting at the discharge nozzle 20 into the venturi zone of a carburetor.

Figure 3A:
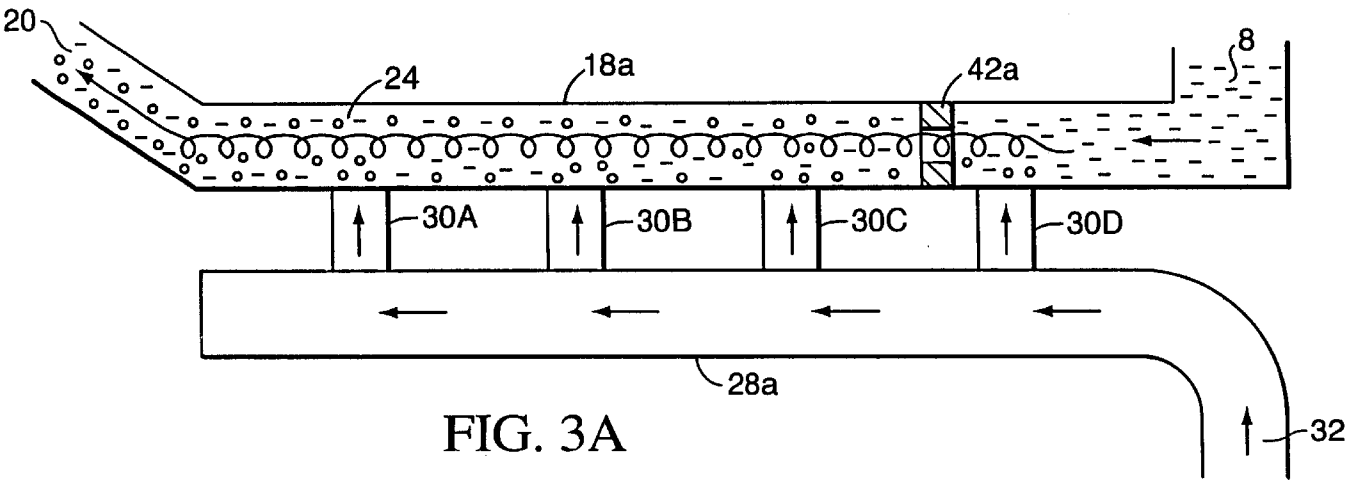
FIG. 3A is an alternative embodiment of the invention shown in FIG. 3.
Figure 3B:
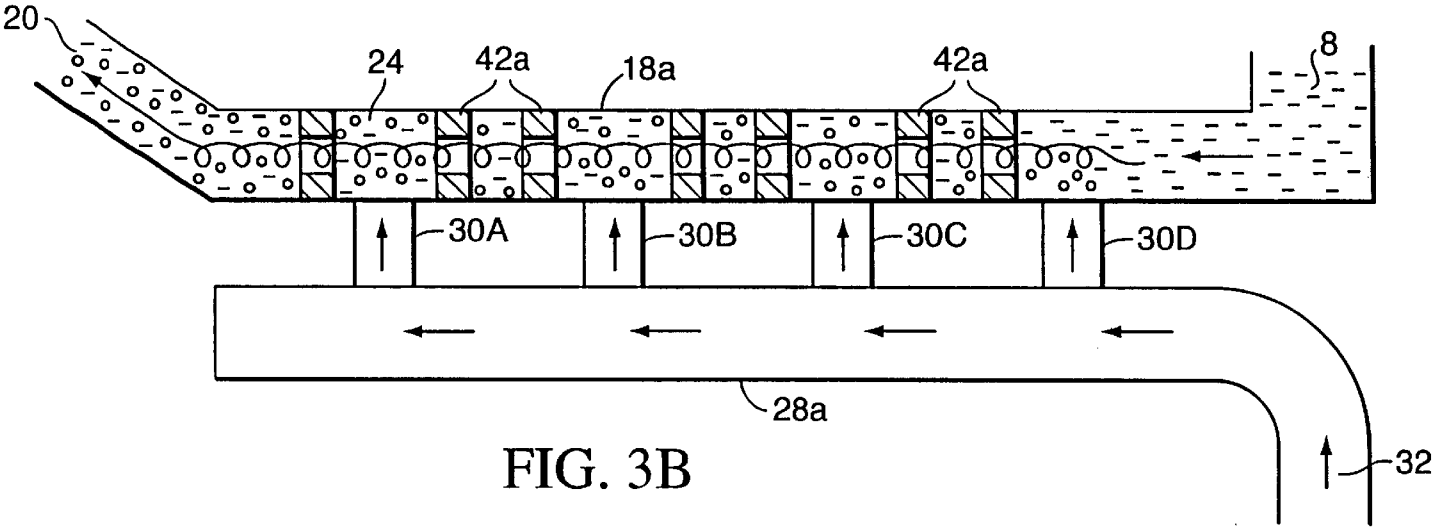
FIG. 3B is another alternative embodiment of the invention shown in FIG. 3.

FIGS. 3A and 3B are further alternatives to the embodiment shown in FIG. 3. In the embodiment of FIG. 3A, only one ring or obstruction 42*a* is employed downstream of the first air inlet 30D. This simple form of the invention will nonetheless result in increased emulsification compared to the prior art. As shown in FIG. 3B, additional rings 42*a* are added downstream of the each additional air inlet 30C, 30B and 30A. Each air inlet and ring or obstruction increases the degree of emulsification of the fuel. Again, the rings or obstructions 42 can be circumferentially continuous on the nominal minor surface of the passage 18*a*, or can be discontinuous or "broken" so as not to form a circumferentially continuous ring.

Figure 3C:
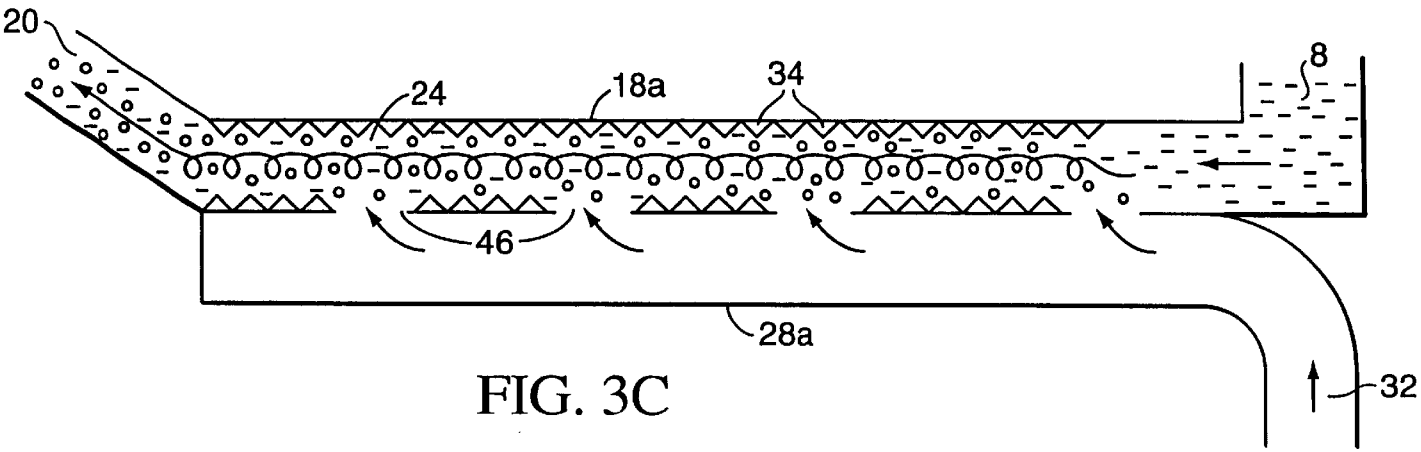
FIG. 3C is another alternative embodiment of the invention shown in FIG. 3.
Figure 3D:
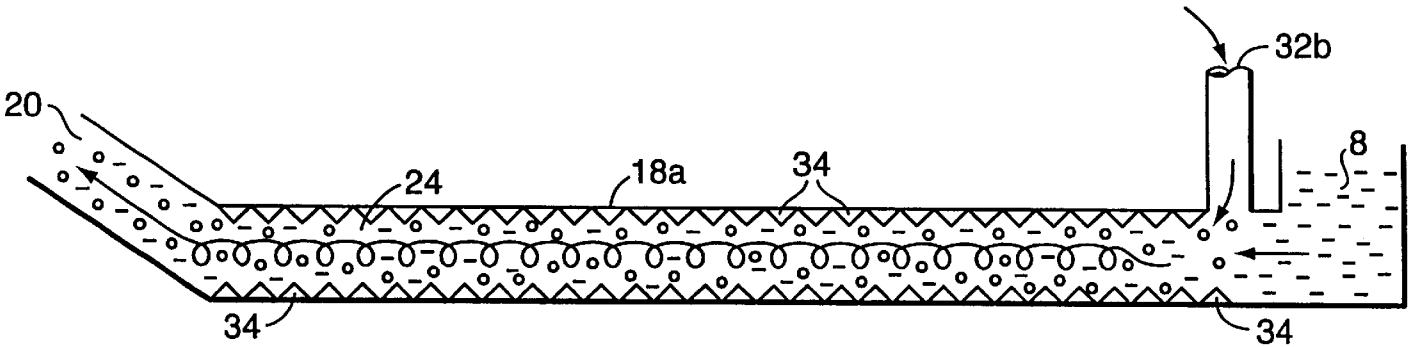
FIG. 3D is a modified version of the invention of FIG. 3.

FIGS. 3C shows a further modification to the structure of FIG. 3 in which fuel passage 18*a* and air passage 28*a* are formed or "siamesed" together. In this embodiment, the air channels 30A–30D are unnecessary, as the ports or air bleeds 46 are simply formed contiguous to both the fuel passage 18*a* an air passage 28*a*. In the embodiment of FIG. 3D, only a single inlet 32*b* is used upstream in the fuel passage 18*a*. Still, even with a single inlet 18*a*, the threads, obstructions or rings 34 will cause the air-fuel to more completely and homogeneously emulsify than in the prior art systems. The tumbling line terminating at the arrowhead at the discharge nozzle 20 is a representation of the rolling, frothing, tumbling path followed by the air-fuel emulsion 24 in the threaded interior of the passage 18*a.*

Figure 4:
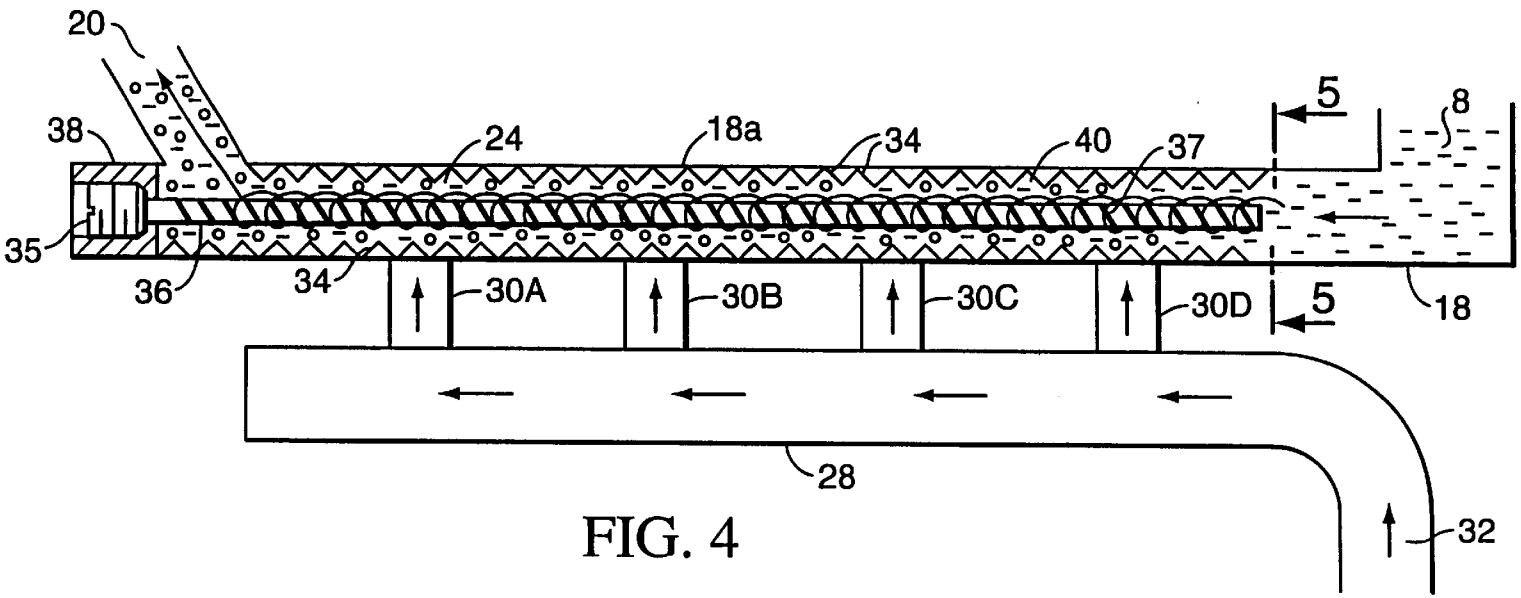
FIG. 4 is a side view of a preferred embodiment of the invention incorporating a restrictor rod.
Figure 5:
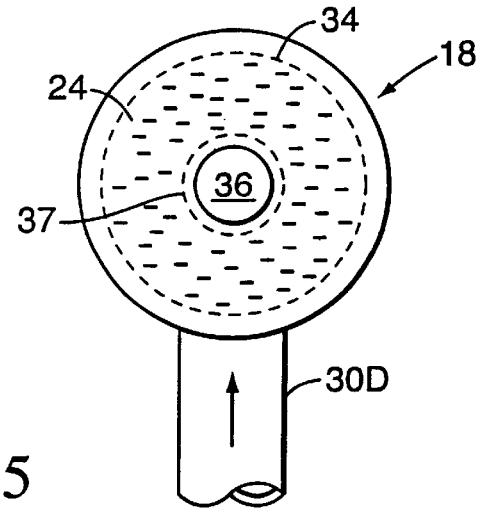
FIG. 5 is a cut away side view taken along line 4—4 of FIG. 4.

FIG. 4 depicts a further modification to the embodiment of FIG. 3. In this modification, a restrictor rod 36 is inserted within the inside of the fuel passage 18*a*. The threaded restrictor rod 36 may be formed or press fit into a set screw 35, which in turn is threaded into the metering block 38. However the exact method or form of maintaining the restrictor rod 36 within the fuel passage 18*a* is not material to the invention. The purpose of the restrictor rod 36 is to maintain the air-fuel mixture in closer contact with the threads, rings or obstructions 34 formed in the fuel passage 18*a*. In still another alternative, the restrictor rod itself may have a threaded surface 37 (represented schematically by the diagonal lines in FIG. 4), thereby adding to the degree of emulsification of the air-fuel mixture. For example, FIG. 5 is a cut-away side view taken along line 4—4 of FIG. 4. In FIG. 4, air enters the main well 18 through air channel 30D to combine with fuel 8 (not shown) to create the emulsified air/fuel mixture 24 within confined passage 40 located between main well threads 34 and restrictor rod threads 37.

The restrictor rod 36 is shown in FIG. 4 as being relatively small in diameter as compared to the available space inboard of the nominal major surface as defined by the projections of the threads. However, the size and cross sectional shape of the rod 36 can vary depending on the application. In a simple form, a small smooth rod centered in the fuel passage 18*a* will restrict the path available to the fuel so that the fuel is in constant proximity with the threads 34 of the passage 18*a*. In another embodiment, the rod 36 could itself be formed as a helix or spiral to induce even more emulsion by both restricting and spiraling the air-fuel mixture.

Figure 6:
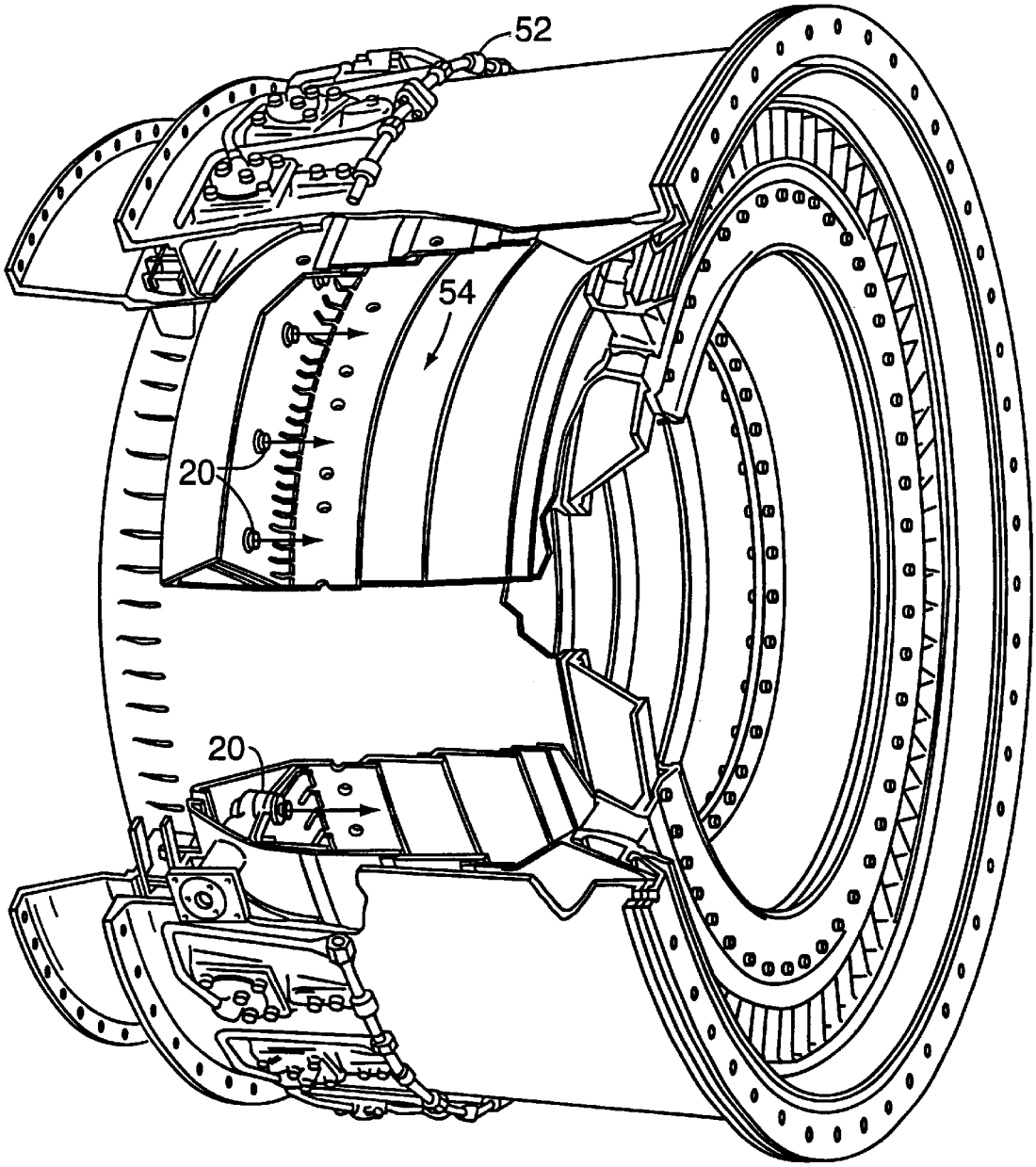
FIG. 6 is a pictorial representation of a jet engine incorporating an alternative embodiment of the invention.

The invention can also be used in other systems where enhanced emulsification is desirable. FIG. 6 depicts one alternative embodiment showing how the invention is used in a jet engine or turbine. Fuel from a fuel manifold 52, and air from an air passage (not shown) are supplied to a plurality of fuel nozzles 20 by methods similar to those described previously. In accordance with the invention fuel nozzles 20, fuel manifold 52 or both are designed with ribs, knurls, threads or a restrictor rod such as in FIGS. 2, 3, and 4. This will cause the air-fuel mixture to more completely and homogeneously emulsify before entering the combustion chamber 54.

Figure 7:
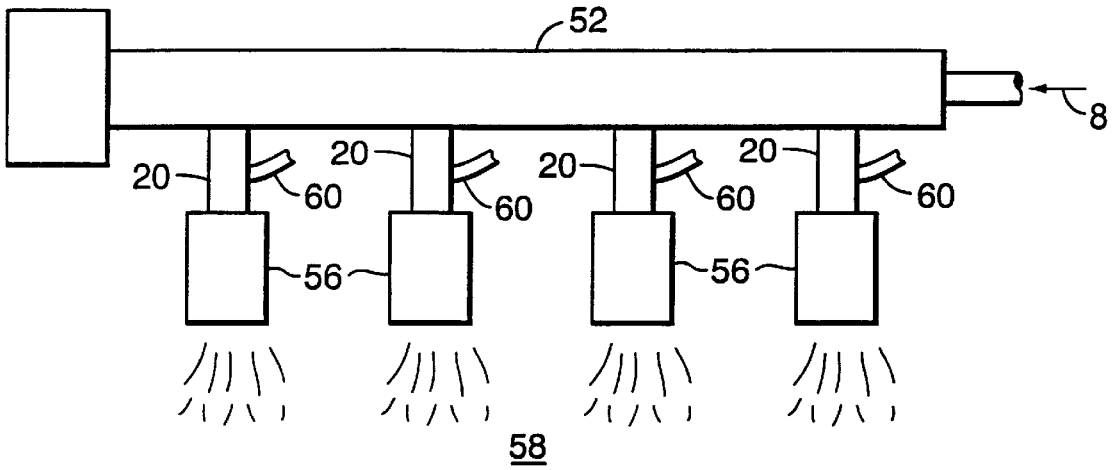
FIG. 7 is a schematic view of an alternative embodiment of the invention in a fuel injection system.

FIG. 7 depicts another alternative embodiment of the invention used in a fuel injection system for an internal combustion engine. Fuel (8) is delivered from a fuel pump (not shown) to the fuel manifold 52. In prior art systems, the fuel injectors 56 are connected directly to the fuel manifold. The injectors 56 deliver fuel into the air entering the combustion area 58 by opening and closing either electronically using a solenoid or mechanically by shifting a needle valve controlled by fuel pressure. To improve the emulsification of the air-fuel mixture prior to entering the combustion area 58 the device of the emulsification improvement system can be placed between the injectors 56 and the fuel manifold 52 in nozzle 20. A secondary under pressure air source 60 enters the nozzle 20 to emulsify the fuel-air mixture by methods described previously.

Home heating furnaces or propane torches could also be modified in much the same way so that air and fuel are emulsified at the end of the fuel nozzle prior to combustion.

Numerous other modifications and features can be selected from each of the embodiments described above and combined to optimize emulsification of the air-fuel mixture to each application. The size and number of air channels 30*a*–30*d* can be altered. The diameter of the restrictor rod or tube 36 and the pitch, lead, thread angle and size of threads 37 can be changed. Similarly the threads 34 in the main well or fluid passage 18 can also be changed.

Thus, the invention comprises a system and method for more thoroughly emulsifying two fluids than was previously capable with the prior art. A first fluid travels through a primary fluid passage. A second fluid is introduced through an inlet to the main fluid passage. At least one interior surface within the primary passage is formed with at least one obstruction thereon at a location downstream relative to the inlet for the second fluid, and causes the two fluids to more thoroughly mix and emulsify.

While particular embodiments of the invention have been shown and described, it will be apparent to those skilled in the art that changes and modifications may be made without departing from the invention in its broader aspects, and, therefore, the inventor's intent in the appended claims is to cover all such changes and modifications as fall within the spirit and scope of the invention and the following claims. For example, the turbulence inducing elements, rings, threads or finds or deflector tabs may take any conceivable form, as long as it at least partially disrupts the smooth wall surface of the fluid passage. Thus, while the drawings show rings and preferably threads, the invention is not limited thereto.

Likewise, the preferred embodiments use fuel as the primary fluid and air as the secondary fluid. However, the invention works well in any application where two fluids are mixed. Thus, while the preferred embodiments describe emulsification of air and fuel in carburetors for combustion engines, many alternative uses exist, including, for example, in furnaces, jet engines, turbines, painting, etc. Thus, the Figures above show no dimensions, and are not to scale even as to related parts. This is because even one relatively small thread, ring or obstruction, located downstream of the inlet for the secondary fluid in a relatively large passage for a primary fluid, will nonetheless result in improved performance relative to the prior art. Of course, flow bench, engine dyno, and other testing will lead quickly to optimization of the specific configuration of the invention for each application.

What is claimed is:

1. Apparatus for maintenance of a homogeneously emulsified air-fuel mixture in a delivery system, said apparatus including a fuel well for emulsifying a primary fluid and a secondary fluid comprising:

(a) the well comprising a primary fluid passage leading to a venturi, the passage having an interior surface;

(b) an emulsion tube having an intake oriface and an air bleed hole, the emulsion tube carried in the primary fluid passage;

(c) an obstruction in the primary fluid passage, the obstruction comprising a plurality of sharp projections comprising a thread, the thread formed on the interior surface of the primary fluid passage, the thread comprising a root portion, and wherein the well comprises a machined wall surface comprising a nominal minor diameter at the root portion of the threads, the obstruction downstream of the air bleed hole of the emulsion tube.

2. The apparatus in accordance with claim 1 wherein the obstruction is comprised of small threads.

3. The apparatus in accordance with claim 2 wherein the small threads are widely spaced.

4. The apparatus in accordance with claim 1 wherein the thread comprises projections having tips and the thread comprises a normal major surface defined by the tips of adjacent projections.

5. The apparatus in accordance with claim 1 wherein the thread comprises numerous projections over which the air-fuel mixture flows.

* * * * *